US010683827B2

(12) United States Patent
Okawa et al.

(10) Patent No.: US 10,683,827 B2
(45) **Date of Patent: *Jun. 16, 2020**

(54) CYLINDER BORE WALL HEAT INSULATION DEVICE, INTERNAL COMBUSTION ENGINE AND VEHICLE

(71) Applicants: NICHIAS CORPORATION, Tokyo (JP); TOYOTA JIDOSHA KABUSHIKI KAISHA, Toyota-shi, Aichi (JP)

(72) Inventors: Satoshi Okawa, Toyota (JP); Tetsu Yamada, Toyota (JP); Takashi Kurauchi, Toyota (JP); Shinpei Yamashita, Ikeda (JP); Kazuaki Nishio, Hamamatsu (JP); Yoshifumi Fujita, Hamamatsu (JP); Yoshihiro Kawasaki, Hamamatsu (JP)

(73) Assignees: NICHIAS CORPORATION, Tokyo (JP); TOYOTA JIDOSHA KABUSHIKI KAISHA, Tokyo (JP)

( * ) Notice: Subject to any disclaimer, the term of this patent is extended or adjusted under 35 U.S.C. 154(b) by 50 days.

This patent is subject to a terminal disclaimer.

(21) Appl. No.: 15/303,279

(22) PCT Filed: Apr. 2, 2015

(86) PCT No.: PCT/JP2015/060507

§ 371 (c)(1),
(2) Date: Oct. 11, 2016

(87) PCT Pub. No.: WO2015/156208

PCT Pub. Date: Oct. 15, 2015

(65) Prior Publication Data

US 2017/0045012 A1 Feb. 16, 2017

(30) Foreign Application Priority Data

Apr. 11, 2014 (JP) ..... 2014-081571

(51) Int. Cl.
*F02F 1/14* (2006.01)
*F01P 3/02* (2006.01)
*F02F 1/16* (2006.01)

(52) U.S. Cl.
CPC *F02F 1/14* (2013.01); *F01P 3/02* (2013.01); *F02F 1/16* (2013.01); *F01P 2003/021* (2013.01)

(58) Field of Classification Search
CPC ..... F02F 1/14
(Continued)

(56) References Cited

U.S. PATENT DOCUMENTS 6,874,451 B2 * 4/2005 Matsutani ..... F01P 3/02 123/41.79
8,037,851 B2 * 10/2011 Kobayashi ..... F01P 3/02 123/142.5 R
(Continued)

FOREIGN PATENT DOCUMENTS

CN 101405491 4/2009
CN 102906406 1/2013
(Continued)

OTHER PUBLICATIONS

Nishio, JP 2012-7478, Jan. 12, 2012, machine translation.*
(Continued)

*Primary Examiner* — Hung Q Nguyen
*Assistant Examiner* — Mark L. Greene
(74) *Attorney, Agent, or Firm* — Nixon & Vanderhye P.C.

(57) ABSTRACT

A cylinder bore wall thermal insulator is provided to a middle-lower part of a groove-like coolant passage of a cylinder block included in an internal combustion engine that includes a plurality of cylinder bores, and insulates part of a cylinder bore wall, the cylinder bore wall thermal insulator including a rubber member that comes in contact
(Continued)

with part of a cylinder bore-side wall surface of the middle-lower part of the groove-like coolant passage that covers one cylinder bore, or covers two or more cylinder bores, a metal base member on which the rubber member is secured, and an elastic member that is provided to the metal base member, and biases the metal base member so that the metal base member presses the rubber member against the cylinder bore-side wall surface of the middle-lower part of the groove-like coolant passage, one or more elastic members being provided to each bore-covering part of the metal base member. The cylinder bore wall thermal insulator can selectively insulate an area of the cylinder bore wall that requires thermal insulation, and is rarely displaced due to vibrations or the flow of the coolant.

18 Claims, 10 Drawing Sheets

(58) Field of Classification Search
USPC ..... 123/41.79
See application file for complete search history.

(56) References Cited

U.S. PATENT DOCUMENTS

| | | | | |
|---|---|---|---|---|
| 8,474,418 | B2 * | 7/2013 | Shikida | F01P 3/02 123/41.74 |
| 9,032,916 | B2 * | 5/2015 | Nishio | F02F 1/10 123/41.72 |
| 2003/0230253 | A1 * | 12/2003 | Matsutani | F01P 3/02 123/41.74 |
| 2009/0031978 | A1 * | 2/2009 | Kobayashi | F01P 3/02 123/142.5 R |
| 2009/0194046 | A1 | 8/2009 | Shikida et al. | |
| 2010/0242868 | A1 * | 9/2010 | Shikida | F01P 3/02 123/41.79 |
| 2013/0160725 | A1 | 6/2013 | Nishio et al. | |
| 2015/0240743 | A1 * | 8/2015 | Nishio | F02F 1/10 123/41.79 |
| 2015/0285125 | A1 * | 10/2015 | Hayman | F02F 1/14 123/41.72 |
| 2016/0017838 | A1 * | 1/2016 | Nishio | F02F 1/14 123/193.2 |
| 2017/0022929 | A1 * | 1/2017 | Karita | F02F 1/14 |
| 2017/0030289 | A1 * | 2/2017 | Okawa | F02F 1/14 |
| 2017/0045012 | A1 | 2/2017 | Okawa et al. | |

FOREIGN PATENT DOCUMENTS

| | | | | |
|---|---|---|---|---|
| EP | 0 261 506 | | 3/1988 | |
| EP | 2 587 035 | | 5/2013 | |
| EP | 3 128 161 | | 2/2017 | |
| EP | 3168449 | A1 * | 5/2017 | |
| JP | 63-147544 | | 9/1988 | |
| JP | 2001159369 | A * | 6/2001 | |
| JP | 2005-120949 | | 5/2005 | |
| JP | 2008-31939 | | 2/2008 | |
| JP | 2008-208744 | | 9/2008 | |
| JP | WO 2011162096 | A1 * | 12/2011 | F02F 1/10 |
| JP | 2012-7478 | | 1/2012 | |
| JP | 2012-7479 | | 1/2012 | |
| JP | 2012007584 | A * | 1/2012 | |
| JP | 2012-112245 | | 6/2012 | |
| JP | 2013-121670 | | 6/2013 | |
| JP | 2015113770 | A * | 6/2015 | |
| JP | 2017002780 | A * | 1/2017 | |
| JP | WO 2017082347 | A1 * | 5/2017 | F01P 3/02 |
| JP | WO 2017082348 | A1 * | 5/2017 | F01P 3/02 |

OTHER PUBLICATIONS

Nishio '478, JP 2012-7478, manual translation. (Year: 2012).*
Nishio '584, JP 2012-7584, manual translation (Year: 2012).*
International Search Report for PCT/JP2015/060507 dated Jun. 23, 2015, 2 pages.
Written Opinion of the ISA for PCT/JP2015/060507 dated Jun. 23, 2015, 4 pages.
International Search Report issued in PCT/JP2015/060505 dated Jun. 23, 2015.
Written Opinion of the International Searching Authority issued in PCT/JP2015/060505 dated Jun. 23, 2015.
Translation of Written Opinion of the International Search Authority issued in PCT/JP2015/060507 dated Jun. 23, 2015.
U.S. Appl. No. 15/302,700, filed Oct. 7, 2016 in the name of Satoshi Okawa et al.
GB Office Action issued in App. No. 1616576.3 dated May 26, 2017.
Chinese Office Action issued in Appln. No. 201580019359.6 dated Feb. 14, 2018 (w/ translation).
Komine, machine translation of JP 2001-159369, Jun. 12, 2001.
Nishio, machine translation of JP 2012-7478, Jan. 12, 2012.
U.S. Office Action issued in U.S. Appl. No. 15/302,700 dated Dec. 11, 2017.
GB Office Action issued in Appln. No. 1616576.3 dated Feb. 7, 2018.
U.S. Office Action issued in U.S. Appl. No. 15/302,700 dated May 18, 2018.
Office Action issued in CN Appln. No. 201580019082.7 dated Feb. 14, 2018 (w/ translation).

* cited by examiner (A)

(B)

CYLINDER BORE WALL HEAT INSULATION DEVICE, INTERNAL COMBUSTION ENGINE AND VEHICLE

This application is the U.S. national phase of International Application No. PCT/JP2015/060507 filed 2 Apr. 2015 which designated the U.S. and claims priority to JP Patent Application No. 2014-081571 filed 11 Apr. 2014, the entire contents of each of which are hereby incorporated by reference.

TECHNICAL FIELD

The present invention relates to a thermal insulator that is disposed to come in contact with the wall surface of a cylinder bore wall that forms a cylinder block included in an internal combustion engine and defines a groove-like coolant passage, an internal combustion engine that includes the thermal insulator, and an automobile that includes the internal combustion engine.

BACKGROUND ART

An internal combustion engine is designed so that fuel explodes within the cylinder bore when the piston is positioned at top dead center, and the piston is moved downward due to the explosion. Therefore, the upper part of the cylinder bore wall increases in temperature as compared with the middle-lower part of the cylinder bore wall. Accordingly, a difference in the amount of thermal deformation occurs between the upper part and the middle-lower part of the cylinder bore wall (i.e., the upper part of the cylinder bore wall expands to a large extent as compared with the middle-lower part of the cylinder bore wall).

As a result, the frictional resistance of the piston against the cylinder bore wall increases, and the fuel consumption increases. Therefore, a reduction in difference in the amount of thermal deformation between the upper part and the middle-lower part of the cylinder bore wall has been desired.

Attempts have been made to control the cooling efficiency in the upper part and the middle-lower part of the cylinder bore wall due to the coolant by disposing a spacer in a groove-like coolant passage to adjust the flow of the coolant in the groove-like coolant passage such that the cylinder bore wall has a uniform temperature. For example, Patent Literature 1 discloses an internal combustion engine heating medium passage partition member that is disposed in a groove-like heating medium passage formed in a cylinder block of an internal combustion engine to divide the groove-like heating medium passage into a plurality of passages, the heating medium passage partition member including a passage division member that is formed at a height above the bottom of the groove-like heating medium passage, and serves as a wall that divides the groove-like heating medium passage into a bore-side passage and a non-bore-side passage, and a flexible lip member that is formed from the passage division member in the opening direction of the groove-like heating medium passage, the edge area of the flexible lip member being formed of a flexible material to extend beyond the inner surface of one of the groove-like heating medium passages, and coming in contact with the inner surface at a middle position of the groove-like heating medium passage in the depth direction due to the flexure restoring force after insertion into the groove-like heating medium passage to separate the bore-side passage and the non-bore-side passage.

CITATION LIST

Patent Literature

Patent Literature 1: JP-A-2008-31939 (claims)

SUMMARY OF INVENTION

Technical Problem

However, since the internal combustion engine heating medium passage partition member disclosed in Patent Literature 1 cannot be strongly pressed against the cylinder bore wall, the internal combustion engine heating medium passage partition member may move within the groove-like coolant passage due to vibrations of the engine.

Since the temperature of the cylinder bore wall is not uniform (i.e., the cylinder bore wall is subjected to a difference in temperature), it is necessary to selectively insulate an area that requires thermal insulation. However, the entire cylinder bore wall is necessarily insulated uniformly when the internal combustion engine heating medium passage partition member disclosed in Patent Literature 1 is used.

Accordingly, an object of the invention is to provide a cylinder bore wall thermal insulator that can selectively insulate an area of the cylinder bore wall that requires thermal insulation, and is rarely displaced due to vibrations or the flow of the coolant.

Solution to Problem

Several aspects of the invention solve the above technical problem by providing the following cylinder bore wall thermal insulator, internal combustion engine, and automobile. According to a first aspect of the invention, a cylinder bore wall thermal insulator is provided to a middle-lower part of a groove-like coolant passage of a cylinder block included in an internal combustion engine that includes a plurality of cylinder bores, and insulates part of a cylinder bore wall, the cylinder bore wall thermal insulator including a rubber member that comes in contact with part of a cylinder bore-side wall surface of the middle-lower part of the groove-like coolant passage that covers one cylinder bore, or covers two or more cylinder bores, a metal base member on which the rubber member is secured, and an elastic member that is provided to the metal base member, and biases the metal base member so that the metal base member presses the rubber member against the cylinder bore-side wall surface of the middle-lower part of the groove-like coolant passage, one or more elastic members being provided to each bore-covering part of the metal base member.

According to a second aspect of the invention, a cylinder bore wall thermal insulator is provided to a middle-lower part of a groove-like coolant passage of a cylinder block included in an internal combustion engine that includes four or more cylinder bores, and insulates part of a cylinder bore wall, the cylinder bore wall thermal insulator including a rubber member that comes in contact with part of a cylinder bore-side wall surface of the middle-lower part of the groove-like coolant passage that covers two or three cylinder bores, a metal base member on which the rubber member is secured, and an elastic member that is provided to the metal base member, and biases the metal base member so that the metal base member presses the rubber member against the cylinder bore-side wall surface of the middle-lower part of the groove-like coolant passage, one or more elastic members being provided to each bore-covering part of the metal base member.

According to a third aspect of the invention, a cylinder bore wall thermal insulator is provided to a middle-lower part of a groove-like coolant passage of a cylinder block included in an internal combustion engine that includes three cylinder bores, and insulates part of a cylinder bore wall, the cylinder bore wall thermal insulator including a rubber member that comes in contact with part of a cylinder bore-side wall surface of the middle-lower part of the groove-like coolant passage that covers two cylinder bores, a metal base member on which the rubber member is secured, and an elastic member that is provided to the metal base member, and biases the metal base member so that the metal base member presses the rubber member against the cylinder bore-side wall surface of the middle-lower part of the groove-like coolant passage, one or more elastic members being provided to each bore-covering part of the metal base member.

According to a fourth aspect of the invention, a cylinder bore wall thermal insulator is provided to a middle-lower part of a groove-like coolant passage of a cylinder block included in an internal combustion engine that includes two or more cylinder bores, and insulates part of a cylinder bore wall, the cylinder bore wall thermal insulator including a rubber member that comes in contact with part of a cylinder bore-side wall surface of the middle-lower part of the groove-like coolant passage that covers one cylinder bore, a metal base member on which the rubber member is secured, and an elastic member that is provided to the metal base member, and biases the metal base member so that the metal base member presses the rubber member against the cylinder bore-side wall surface of the middle-lower part of the groove-like coolant passage, one or more elastic members being provided to each bore-covering part of the metal base member.

According to a fifth aspect of the invention, an internal combustion engine includes the cylinder bore wall thermal insulator according to any one of the first to fourth aspects of the invention.

According to a sixth aspect of the invention, an automobile includes the internal combustion engine according to the fifth aspect of the invention.

Advantageous Effects of Invention

The aspects of the invention thus provide a cylinder bore wall thermal insulator that can selectively insulate an area of the cylinder bore wall that requires thermal insulation, and is rarely displaced due to vibrations or the flow of the coolant.

DESCRIPTION OF EMBODIMENTS

Figure 1:
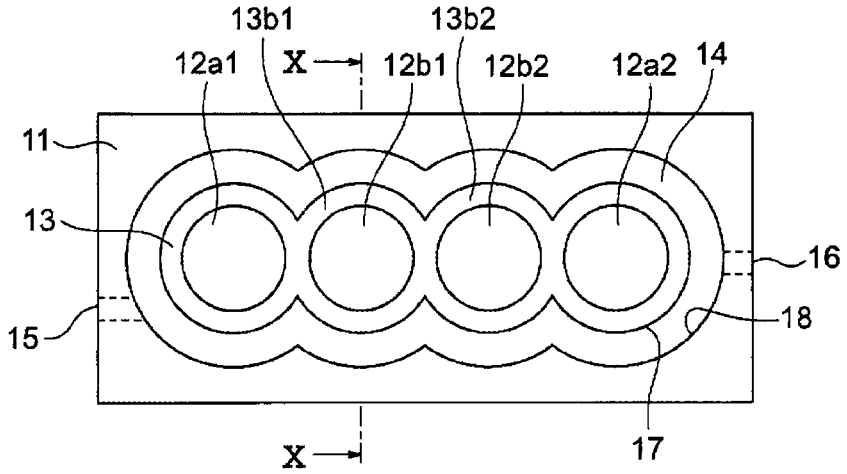
FIG. 1 is a schematic plan view illustrating an example of a cylinder block in which a cylinder bore wall thermal insulator according to one embodiment of the invention is disposed.
Figure 2:
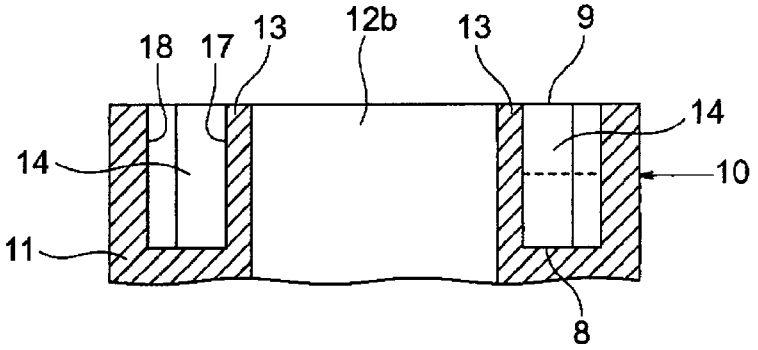
FIG. 2 is a cross-sectional view taken along the line x-x illustrated in FIG. 1.
Figure 3:
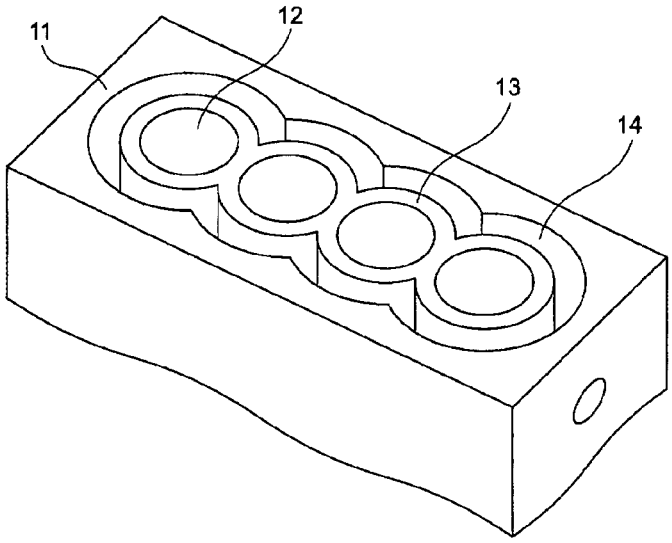
FIG. 3 is a perspective view illustrating the cylinder block illustrated in FIG. 1.
Figure 4:
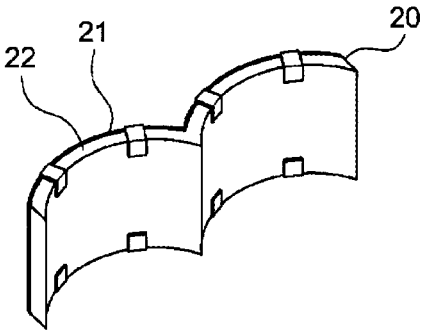
FIGS. 4A and 4B are schematic perspective views illustrating an example of a cylinder bore wall thermal insulator according to one embodiment of the invention.
Figure 4:
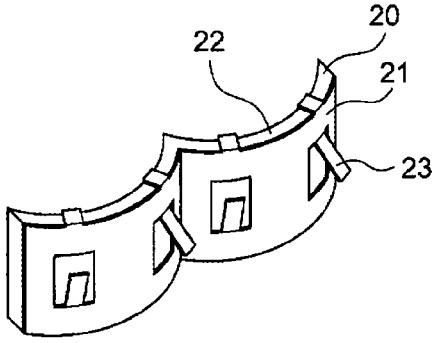
Figure 5:
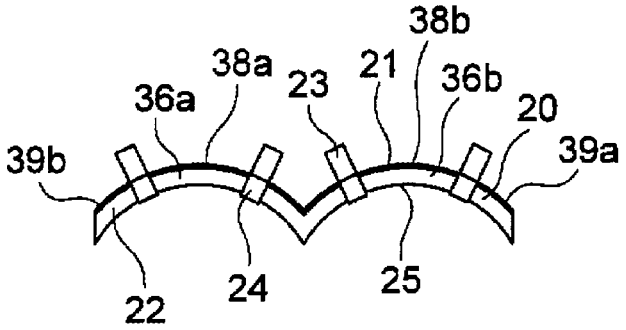
FIG. 5 is a top plan view illustrating the cylinder bore wall thermal insulator illustrated in FIGS. 4A and 4B.
Figure 6:
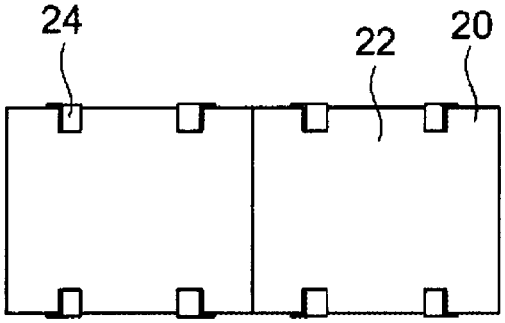
FIG. 6 is a side view illustrating the cylinder bore wall thermal insulator (rubber member) illustrated in FIGS. 4A and 4B.
Figure 7:
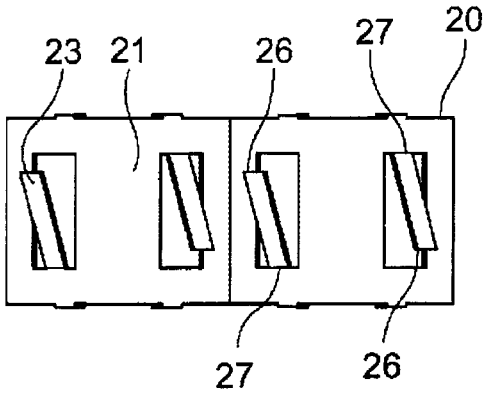
FIG. 7 is a side view illustrating the cylinder bore wall thermal insulator (metal base member) illustrated in FIGS. 4A and 4B.
Figure 8:
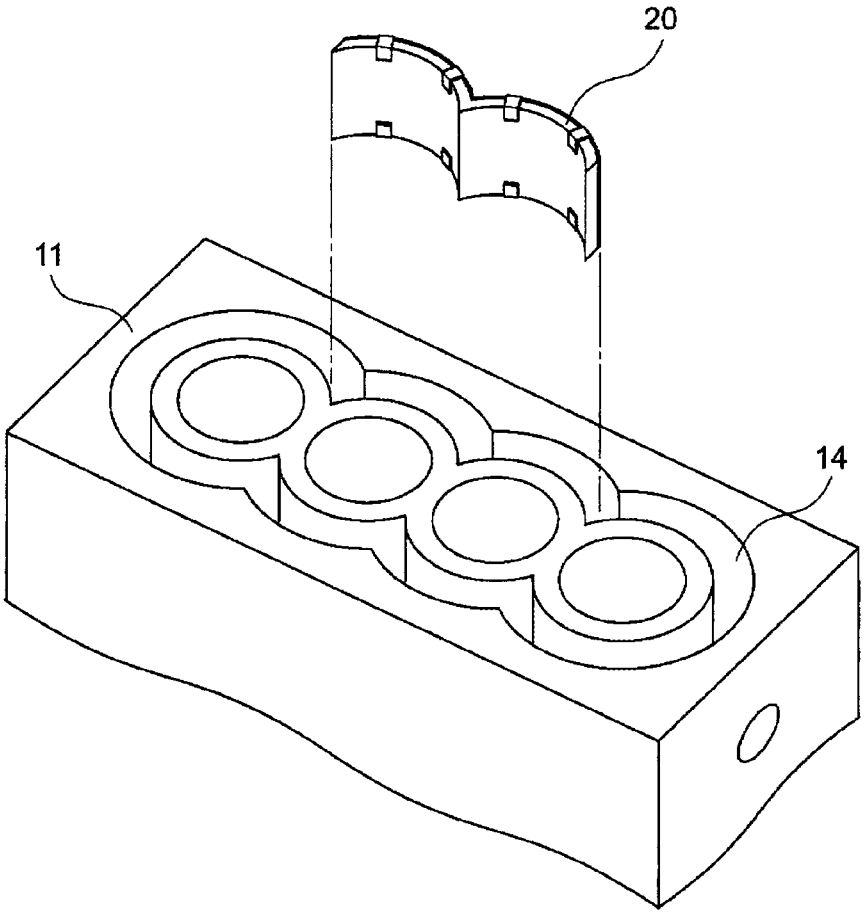
FIG. 8 is a schematic view illustrating a state in which a cylinder bore wall thermal insulator (20) is provided to the cylinder block (11) illustrated in FIG. 1.
Figure 9:
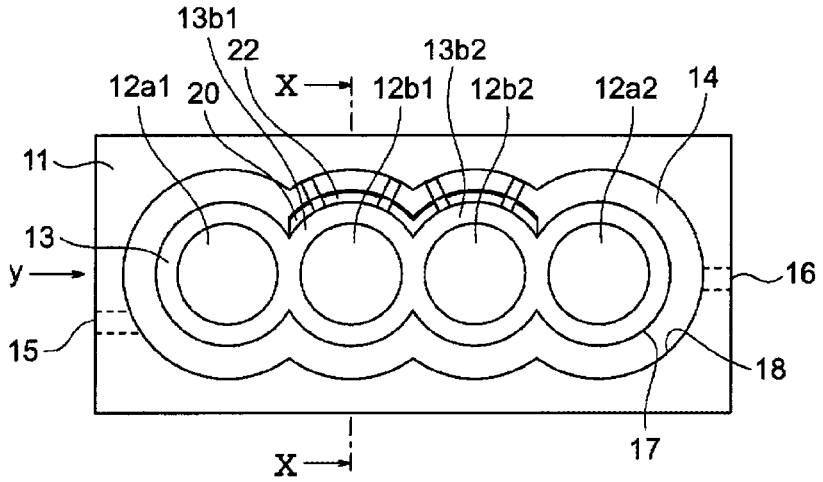
FIG. 9 is a schematic view illustrating a state in which a cylinder bore wall thermal insulator (20) has been provided to the cylinder block (11) illustrated in FIG. 1.
Figure 10:
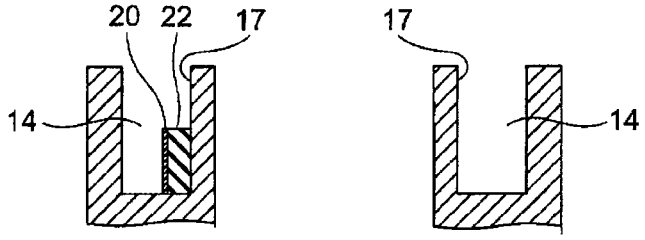
FIG. 10 is an end view taken along the line x-x illustrated in FIG. 9.

A cylinder bore wall thermal insulator and an internal combustion engine according to the exemplary embodiments of the invention are described below with reference to FIGS. 1 to 10. FIGS. 1 to 3 illustrate an example of a cylinder block in which the cylinder bore wall thermal insulator according to one embodiment of the invention is disposed. FIG. 1 is a schematic plan view illustrating the cylinder block in which the cylinder bore wall thermal insulator according to one embodiment of the invention is disposed, FIG. 2 is a cross-sectional view taken along the line x-x illustrated in FIG. 1, and FIG. 3 is a perspective view illustrating the cylinder block illustrated in FIG. 1. FIGS. 4A to 7 illustrate an example of the cylinder bore wall thermal insulator according to one embodiment of the invention. FIGS. 4A and 4B are schematic perspective views illustrating an example of the cylinder bore wall thermal insulator according to one embodiment of the invention, wherein FIG. 4A is a perspective view illustrating the side where a rubber member is provided, and FIG. 4B is a perspective view illustrating the side where a metal base member is provided. FIG. 5 is a top plan view illustrating the cylinder bore wall thermal insulator illustrated in FIGS. 4A and 4B, FIG. 6 is a side view illustrating the rubber member of the cylinder bore wall thermal insulator illustrated in FIGS. 4A and 4B, and FIG. 7 is a side view illustrating the metal base member of the cylinder bore wall thermal insulator illustrated in FIGS. 4A and 4B. FIG. 8 is a schematic view illustrating a state in which a cylinder bore wall thermal insulator (20) is provided to (inserted into) the cylinder block (11) illustrated in FIG. 1, FIG. 9 is a schematic view illustrating a state in which the cylinder bore wall thermal insulator (20) has been provided to (inserted into) the cylinder block (11) illustrated in FIG. 1, and FIG. 10 is an end view taken along the line x-x illustrated in FIG. 9.

As illustrated in FIGS. 1 to 3, an open-deck cylinder block 11 for an automotive internal combustion engine (in which the cylinder bore wall thermal insulator is disposed) includes a plurality of bores 12 and a groove-like coolant passage 14, a piston moving upward and downward in each bore 12, and a coolant flowing through the groove-like coolant passage 14. The boundary between the bores 12 and the groove-like coolant passage 14 is defined by a cylinder bore wall 13. The cylinder block 11 also includes a coolant inlet 15 for supplying the coolant to the groove-like coolant passage 14, and a coolant outlet 16 for discharging the coolant from the groove-like coolant passage 14.

The cylinder block 11 includes two or more bores 12 that are formed (arranged) in series. Specifically, the bores 12 include end bores 12*a*1 and 12*a*2 that are formed to be adjacent to one bore, and intermediate bores 12*b*1 and 12*b*2 that are formed between two bores. Note that only the end bores are provided when the number of bores formed in the cylinder block is 2. The end bores 12*a*1 and 12*a*2 among the bores 12 that are arranged in series are bores situated on either end, and the intermediate bores 12*b*1 and 12*b*2 among the bores 12 that are arranged in series are bores situated between the end bore 12*a*1 situated on one end and the end bore 12*a*2 situated on the other end.

Note that the wall surface of the groove-like coolant passage 14 that is situated on the side of the cylinder bores is referred to as "cylinder bore-side wall surface 17", and the wall surface of the groove-like coolant passage 14 that is situated opposite to the cylinder bore-side wall surface 17 is referred to as "wall surface 18".

The cylinder bore wall thermal insulator 20 illustrated in FIGS. 4A to 7 includes a metal base member 21, a rubber member 22, and a metal leaf spring member 23.

The rubber member 22 is formed to have a shape in which two arcs are consecutively formed when viewed from above. A contact surface 25 of the rubber member 22 has a shape that conforms to the shape of the cylinder bore-side wall surface 17 of the middle-lower part (insulation target) of the groove-like coolant passage 14. The rubber member 22 is secured on the metal base member 21 in a state in which bendable parts 24 that are formed on the upper side and the lower side of the metal base member 21 are bent so that the rubber member 22 is held between the metal base member 21 and the bendable parts 24. The contact surface 25 of the rubber member 22 that is situated opposite to the metal base member 21 comes in contact with the cylinder bore-side wall surface 17 of the middle-lower part of the groove-like coolant passage 14.

The metal base member 21 is formed to have a shape in which two arcs are consecutively formed when viewed from above. The metal base member 21 has a shape that conforms to the shape of the back surface of the rubber member 22 (that is situated opposite to the contact surface 25).

The rubber member 22 of the cylinder bore wall thermal insulator 20 includes a bore-covering part 36*a* that comes in contact with the cylinder bore-side wall surface of the middle-lower part of the groove-like coolant passage 14 in an area corresponding to the intermediate bore 12*b*1, and a bore-covering part 36*b* that comes in contact with the cylinder bore-side wall surface of the middle-lower part of the groove-like coolant passage 14 in an area corresponding to the intermediate bore 12*b*2. The bore-covering part 36*a* of the rubber member 22 insulates a bore wall 13*b*1 of the intermediate bore 12*b*1, and the bore-covering part 36*b* of the rubber member 22 insulates a bore wall 13*b*2 of the intermediate bore 12*b*2.

The metal base member 21 of the cylinder bore wall thermal insulator 20 includes a bore-covering part 38*a* on which the bore-covering part 36*a* is secured, and a bore-covering part 38*b* on which the bore-covering part 36*b* is secured. The metal base member 21 is formed of a single metal sheet. The metal base member 21 of the cylinder bore wall thermal insulator 20 has one end 39*a* and another end 39*b*.

The metal base member 21 is provided with the metal leaf spring member 23 that is integrally formed with the metal base member 21. The metal leaf spring member 23 is a plate-shaped elastic body that is formed of a metal. The metal leaf spring member 23 is bent with respect to the metal base member 21 at an end 27 (i.e., the other end) so that an end 26 (i.e., one end) is situated away from the metal base member 21.

The cylinder bore wall thermal insulator 20 is provided to the middle-lower part of the groove-like coolant passage 14 of the cylinder block 11 illustrated in FIG. 1, for example. As illustrated in FIG. 8, the cylinder bore wall thermal insulator 20 is inserted into the groove-like coolant passage 14 of the cylinder block 11 so that the cylinder bore wall thermal insulator 20 is provided to the middle-lower part of the groove-like coolant passage 14 (see FIGS. 9 and 10). Since the rubber member 22 of the cylinder bore wall thermal insulator 20 has a shape that conforms to the shape of part of the cylinder bore-side wall surface 17 of the middle-lower part of the groove-like coolant passage 14 that is formed along the cylinder bores 12*b*1 and 12*b*2, the cylinder bore wall thermal insulator 20 is provided to the middle-lower part of the groove-like coolant passage 14 so that the rubber member 22 comes in contact with part of the cylinder bore-side wall surface 17 that is formed along the cylinder bores 12*b*1 and 12*b*2.

The metal leaf spring member 23 of the cylinder bore wall thermal insulator 20 is provided so that the distance from the contact surface 25 of the rubber member 22 to the end 26 of the metal leaf spring member 23 is greater than the width of the groove-like coolant passage 14. Therefore, when the cylinder bore wall thermal insulator 20 has been provided to the middle-lower part of the groove-like coolant passage 14, the metal leaf spring member 23 is held between the metal base member 21 (rubber member 22) and the wall surface 18, and a force that pushes the end 26 of the metal leaf spring member 23 toward the metal base member 21 is applied to the end 26 of the metal leaf spring member 23. Since the metal leaf spring member 23 is deformed so that the end 26 moves closer to the metal base member 21, the metal leaf spring member 23 produces an elastic force that causes the metal leaf spring member 23 to return to the original position. The metal base member 21 is pressed against the cylinder bore-side wall surface 17 of the groove-like coolant passage 14 due to the elastic force, and the rubber member 22 is pressed against the cylinder bore-side wall surface 17 of the groove-like coolant passage 14 due to the metal base member 21. Specifically, the metal leaf spring member 23 is deformed when the cylinder bore wall thermal insulator 20 has been provided to the middle-lower part of the groove-like coolant passage 14, and the metal base member 21 is biased due to the elastic force that occurs due to the deformation so as to press the rubber member 22 against the cylinder bore-side wall surface 17 of the groove-like coolant passage 14. The rubber member 22 of the cylinder bore wall thermal insulator 20 thus comes in contact with part of the cylinder bore-side wall surface 17 of the middle-lower part of the groove-like coolant passage 14 that is formed along the cylinder bores 12*b*1 and 12*b*2.

The cylinder bore wall thermal insulator 20 is produced using the method illustrated in FIGS. 11 to 15, for example. Note that the cylinder bore wall thermal insulator according to one embodiment of the invention may be produced using a method other than the method described below.

Figure 11:
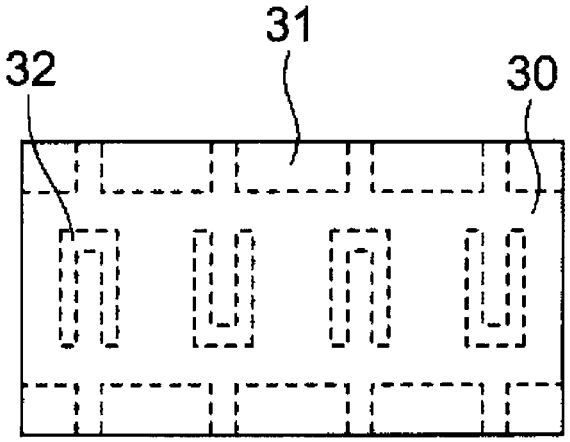
FIG. 11 is a schematic view illustrating an example of a method for producing a cylinder bore wall thermal insulator.
Figure 12:
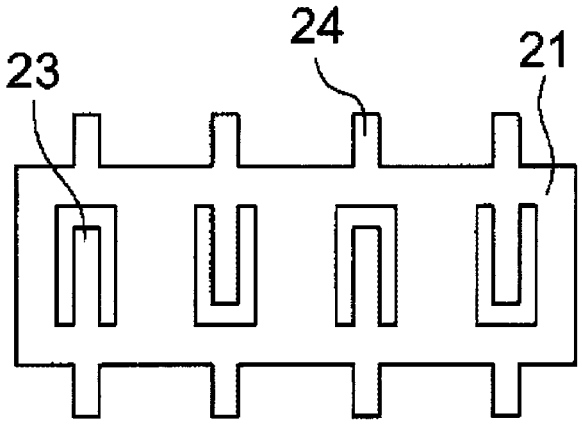
FIG. 12 is a schematic view illustrating an example of a method for producing a cylinder bore wall thermal insulator.

As illustrated in FIG. 11, clipping target parts 31 and 32 (see the dotted lines) are removed by cutting from a rectangular metal sheet 30 to obtain the metal base member 21 (that is to be formed) illustrated in FIG. 12. The metal base member 21 is provided with the bendable parts 24 that are formed on the upper side and the lower side, and the metal leaf spring members 23 (situated in the center area) are integrally formed with the metal base member 21.

Figure 13:
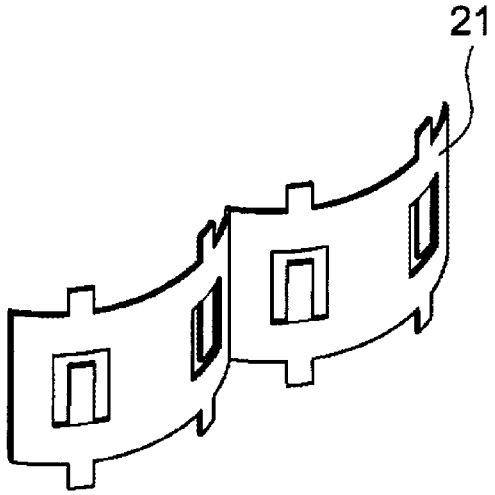
FIG. 13 is a schematic view illustrating an example of a method for producing a cylinder bore wall thermal insulator.
Figure 14:
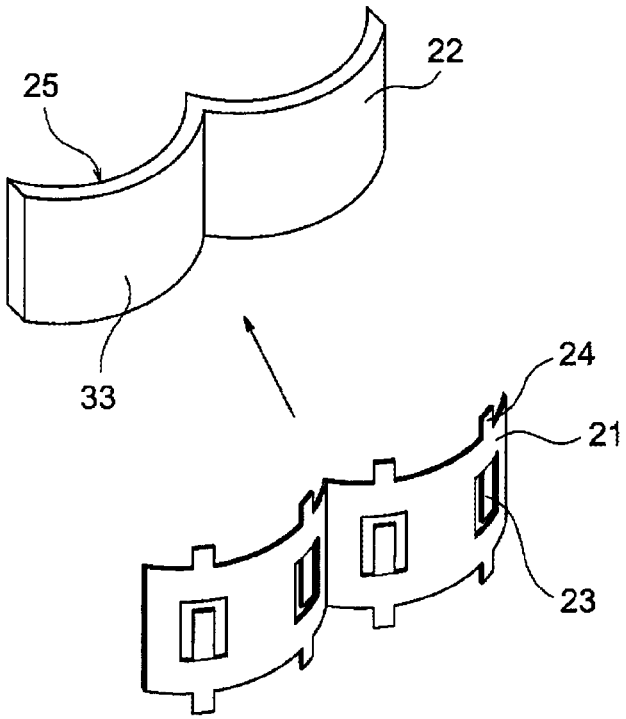
FIG. 14 is a schematic view illustrating an example of a method for producing a cylinder bore wall thermal insulator.
Figure 15:
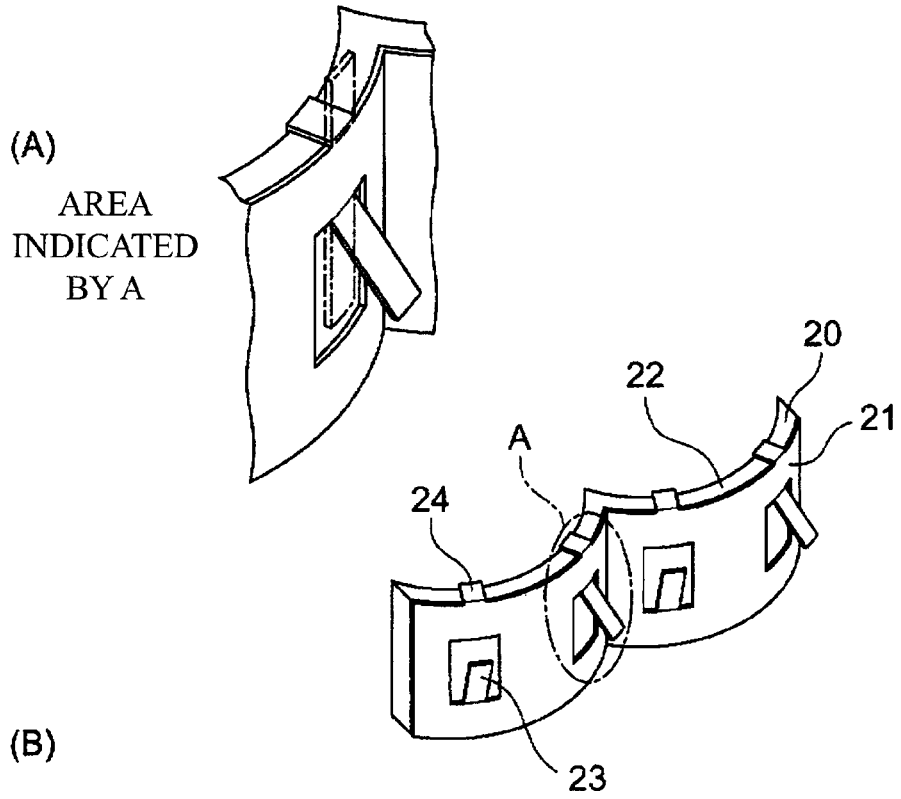
FIGS. 15A and 15B are schematic views illustrating an example of a method for producing a cylinder bore wall thermal insulator.

As illustrated in FIG. 13, the metal base member 21 is formed to have a shape that conforms to the shape of the back surface of the rubber member 22 (i.e., the back surface 33 of the rubber member 22 illustrated in FIG. 14).

As illustrated in FIG. 14, the metal base member 21 that has been formed is bonded to the rubber member 22 that has been formed so that the contact surface 25 has a shape that conforms to the shape of the cylinder bore-side wall surface 17 of the middle-lower part of the groove-like coolant passage 14.

As illustrated in FIGS. 15A and 15B, the bendable parts 24 are bent so that the rubber member 22 is held between the bendable parts 24 and the metal base member 21 to secure the rubber member 22 on the metal base member 21. The metal leaf spring members 23 are also bent. In FIGS. 15A and 15B, the positions of the bendable part 24 and the metal spring member 23 that have not been bent are indicated by the dotted lines (see the part A enclosed by the two-dot chain line).

The cylinder bore wall thermal insulator according to one embodiment of the invention is provided to a middle-lower part of a groove-like coolant passage of a cylinder block included in an internal combustion engine that includes a plurality of cylinder bores, and insulates part of a cylinder bore wall, the cylinder bore wall thermal insulator including a rubber member that comes in contact with part of a cylinder bore-side wall surface of the middle-lower part of the groove-like coolant passage that covers one cylinder bore, or covers two or more cylinder bores, a metal base member on which the rubber member is secured, and an elastic member that is provided to the metal base member, and biases the metal base member so that the metal base member presses the rubber member against the cylinder bore-side wall surface of the middle-lower part of the groove-like coolant passage, one or more elastic members being provided to each bore-covering part of the metal base member.

Examples of the cylinder bore wall thermal insulator according to one embodiment of the invention include a cylinder bore wall thermal insulator according to a first embodiment of the invention, a cylinder bore wall thermal insulator according to a second embodiment of the invention, and a cylinder bore wall thermal insulator according to a third embodiment of the invention (see below).

The cylinder bore wall thermal insulator according to the first embodiment of the invention (hereinafter may be referred to as "cylinder bore wall thermal insulator (1)") is provided to a middle-lower part of a groove-like coolant passage of a cylinder block included in an internal combustion engine that includes four or more cylinder bores, and insulates part of a cylinder bore wall, the cylinder bore wall thermal insulator including a rubber member that comes in contact with part of a cylinder bore-side wall surface of the middle-lower part of the groove-like coolant passage that covers two or three cylinder bores, a metal base member on which the rubber member is secured, and an elastic member that is provided to the metal base member, and biases the metal base member so that the metal base member presses the rubber member against the cylinder bore-side wall surface of the middle-lower part of the groove-like coolant passage, one or more elastic members being provided to each bore-covering part of the metal base member.

The cylinder bore wall thermal insulator according to the second embodiment of the invention (hereinafter may be referred to as "cylinder bore wall thermal insulator (2)") is provided to a middle-lower part of a groove-like coolant passage of a cylinder block included in an internal combustion engine that includes three cylinder bores, and insulates part of a cylinder bore wall, the cylinder bore wall thermal insulator including a rubber member that comes in contact with part of a cylinder bore-side wall surface of the middle-lower part of the groove-like coolant passage that covers two cylinder bores, a metal base member on which the rubber member is secured, and an elastic member that is provided to the metal base member, and biases the metal base member so that the metal base member presses the rubber member against the cylinder bore-side wall surface of the middle-lower part of the groove-like coolant passage, one or more elastic members being provided to each bore-covering part of the metal base member.

The cylinder bore wall thermal insulator according to the third embodiment of the invention (hereinafter may be referred to as "cylinder bore wall thermal insulator (3)") is provided to a middle-lower part of a groove-like coolant passage of a cylinder block included in an internal combustion engine that includes two or more cylinder bores, and insulates part of a cylinder bore wall, the cylinder bore wall thermal insulator including a rubber member that comes in contact with part of a cylinder bore-side wall surface of the middle-lower part of the groove-like coolant passage that covers one cylinder bore, a metal base member on which the rubber member is secured, and an elastic member that is provided to the metal base member, and biases the metal base member so that the metal base member presses the rubber member against the cylinder bore-side wall surface of the middle-lower part of the groove-like coolant passage, one or more elastic members being provided to each bore-covering part of the metal base member.

The cylinder bore wall thermal insulators (1), (2), and (3) have an identical configuration, except that the cylinder bore wall thermal insulators (1), (2), and (3) differ from each other as to the number of cylinder bores of the cylinder block that are covered by the thermal insulator, and the number of bore-covering parts.

The cylinder bore wall thermal insulators (1), (2), and (3) are provided to the middle-lower part of the groove-like coolant passage of the cylinder block included in the internal combustion engine. The cylinder block in which the cylinder bore wall thermal insulator (1) is provided is an open-deck cylinder block in which four or more cylinder bores are formed to be arranged in series. Specifically, the cylinder block in which the cylinder bore wall thermal insulator (1) is provided includes cylinder bores including two end bores and two or more intermediate bores. The cylinder block in which the cylinder bore wall thermal insulator (2) is provided, is an open-deck cylinder block in which three cylinder bores are formed to be arranged in series. Specifically, the cylinder block in which the cylinder bore wall thermal insulator (2) is provided includes cylinder bores including two end bores and one intermediate bore. The cylinder block in which the cylinder bore wall thermal insulator (3) is provided is an open-deck cylinder block in which two or more cylinder bores are formed to be arranged in series. Specifically, the cylinder block in which the cylinder bore wall thermal insulator (3) is provided includes cylinder bores including two end bores, or cylinder bores including two end bores and one or more intermediate bores. Note that the term "end bore" used herein refers to a cylinder bore among a plurality of cylinder bores arranged in series that is situated on either end, and the term "intermediate bore" used herein refers to a cylinder bore among a plurality of cylinder bores arranged in series that is situated between other cylinder bores among the plurality of cylinder bores.

The cylinder bore wall thermal insulators (1), (2), and (3) are provided to the middle-lower part of the groove-like coolant passage. In FIG. 2, the dotted line indicates an intermediate position (10) between the uppermost position (uppermost side) (9) and the lowermost position (lowermost side) (8) of the groove-like coolant passage 14. The term "middle-lower part" used herein in connection with the groove-like coolant passage refers to the part of the groove-like coolant passage 14 that is situated under the intermediate position 10. Note that the term "middle-lower part" used herein in connection with the groove-like coolant passage does not necessarily refer to the part of the groove-like coolant passage that is situated under the middle position between the uppermost position and the lowermost position, but also refers to the part of the groove-like coolant passage that is situated under an approximately middle position (i.e., an arbitrary intermediate position) between the uppermost position and the lowermost position. Specifically, the part (i.e., middle-lower part) of the groove-like coolant passage that is insulated using the cylinder bore wall thermal insulator according to one embodiment of the invention (i.e., the position of the upper end of the rubber member with respect to the groove-like coolant passage in the upward-downward direction) is appropriately selected.

The rubber member comes in contact with the cylinder bore-side wall surface of the middle-lower part of the groove-like coolant passage to insulate the middle-lower part of the cylinder bore wall. Therefore, the contact surface of the rubber member (that comes in contact with the cylinder bore-side wall surface of the middle-lower part of the groove-like coolant passage) is formed to have a shape that conforms to the shape of the cylinder bore-side wall surface of the middle-lower part of the groove-like coolant passage. When the cylinder bore wall thermal insulator according to one embodiment of the invention is provided to the middle-lower part of the groove-like coolant passage, the metal base member is pushed through the elastic member, and the contact surface (that is situated opposite to the metal base member) of the rubber member comes in contact with (is pressed against) the cylinder bore-side wall surface of the middle-lower part of the groove-like coolant passage.

Examples of a material for forming the rubber member include a rubber such as a solid rubber, an expanded rubber, a foamed rubber, and a soft rubber, a silicone-based gel-like material, and the like. It is preferable to use a heat-expandable rubber or a water-swellable rubber as the material for forming the rubber member so that the rubber member expands after the cylinder bore wall thermal insulator has been provided to the groove-like coolant passage. When a heat-expandable rubber or a water-swellable rubber is used as the material for forming the rubber member, it is possible to prevent a situation in which the rubber member comes in strong contact with the cylinder bore wall (i.e., the rubber member is shaved) when the cylinder bore wall thermal insulator is provided to (inserted into) the groove-like coolant passage.

Examples of the solid rubber include a rubber such as a natural rubber, a butadiene rubber, an ethylene-propylene-diene rubber (EPDM), a nitrile-butadiene rubber (NBR), a silicone rubber, a fluororubber, and the like.

Examples of the expandable rubber include a heat-expandable rubber. The term "heat-expandable rubber" used herein refers to a composite obtained by impregnating a base foam material with a thermoplastic substance having a melting point lower than that of the base foam material, and compressing the resulting product. The heat-expandable rubber is characterized in that the compressed state is maintained at room temperature by the cured product of the thermoplastic substance that is present at least in the surface area, and the cured product of the thermoplastic substance softens due to heating so that the compressed state is canceled. Examples of the heat-expandable rubber include the heat-expandable rubber disclosed in JP-A-2004-143262. When the heat-expandable rubber is used as the material for forming the rubber member, the heat-expandable rubber expands (is deformed) to have a specific shape when the cylinder bore wall thermal insulator according to one embodiment of the invention has been provided to the middle-lower part of the groove-like coolant passage, and heat has been applied to the heat-expandable rubber.

Examples of the base foam material used to produce the heat-expandable rubber include a polymer material such as a rubber, an elastomer, a thermoplastic resin, and a thermosetting resin. Specific examples of the base foam material include a natural rubber, a synthetic rubber such as a chloropropylene rubber, a styrene-butadiene rubber, a nitrile-butadiene rubber, an ethylene-propylene-diene terpolymer, a silicone rubber, a fluororubber, and an acrylic rubber, an elastomer such as soft urethane, and a thermosetting resin such as rigid urethane, a phenolic resin, and a melamine resin.

It is preferable to use a thermoplastic substance having a glass transition temperature, a melting point, or a softening temperature of less than 120° C. as the thermoplastic substance used to produce the heat-expandable rubber. Examples of the thermoplastic substance used to produce the heat-expandable rubber include a thermoplastic resin such as polyethylene, polypropylene, polystyrene, polyvinyl chloride, polyvinylidene chloride, polyvinyl acetate, a polyacrylate, a styrene-butadiene copolymer, chlorinated polyethylene, polyvinylidene fluoride, an ethylene-vinyl acetate copolymer, an ethylene-vinyl acetate-vinyl chloride-acrylate copolymer, an ethylene-vinyl acetate-acrylate copolymer, an ethylene-vinyl acetate-vinyl chloride copolymer, nylon, an acrylonitrile-butadiene copolymer, polyacrylonitrile, polyvinyl chloride, polychloroprene, polybutadiene, a thermoplastic polyimide, a polyacetal, polyphenylene sulfide, a polycarbonate, and a thermoplastic polyurethane, and a thermoplastic compound such as a low-melting-point glass frit, starch, a solder, and a wax.

The water-swellable rubber may also be used as the expandable rubber. The term "water-swellable rubber" used herein refers to a material obtained by adding a water-absorbing substance to a rubber. The water-swellable rubber is a rubber material that swells by absorbing water, and retains the swollen shape (i.e., has a shape retention capability). Examples of the water-swellable rubber include a rubber material obtained by adding a water-absorbing substance such as a cross-linked neutralized polyacrylic acid, a cross-linked starch-acrylic acid graft copolymer, a cross-linked carboxymethyl cellulose salt, or polyvinyl alcohol, to a rubber. Specific examples of the water-swellable rubber include the water-swellable rubber disclosed in JP-A-9-208752 that includes a ketiminated polyamide resin, a glycidyl ether, a water-absorbing resin, and a rubber. When the water-swellable rubber is used as the material for forming the rubber member, the water-swellable rubber expands (is deformed) to have a specific shape when the cylinder bore wall thermal insulator according to one embodiment of the invention has been provided to the middle-lower part of the groove-like coolant passage, and the water-swellable rubber has absorbed water.

The foamed rubber is a porous rubber. Examples of the foamed rubber include a sponge-like foamed rubber having a continuous cell structure, a foamed rubber having a closed cell structure, a foamed rubber having a semi-closed cell structure, and the like. Examples of a material for producing the foamed rubber include an ethylene-propylene-diene terpolymer, a silicone rubber, a nitrile-butadiene copolymer, a silicone rubber, a fluororubber, and the like. The expansion ratio of the foamed rubber is appropriately selected. The water content in the rubber member can be adjusted by adjusting the expansion ratio. Note that the expansion ratio of the foamed rubber refers to the density ratio calculated by "((density before foaming−density after foaming)/density before foaming)×100".

When a material that can absorb water (e.g., water-swellable rubber and foamed rubber) is used as the material for forming the rubber member, the rubber member absorbs water when the cylinder bore wall thermal insulator according to one embodiment of the invention has been provided in the groove-like coolant passage, and the coolant is passed through the groove-like coolant passage. The water content in the rubber member achieved when the coolant is passed through the groove-like coolant passage is appropriately selected taking account of the internal combustion engine operating conditions and the like. Note that the water content refers to the water content based on weight calculated by "(weight of coolant/(weight of filler+weight of coolant))×100".

The thickness of the rubber member is not particularly limited, and is appropriately selected.

The metal base member is a member on which the rubber member is secured. The metal base member is a member that is pushed by the elastic force produced by the deformation of the elastic member to uniformly press the rubber member against the cylinder bore-side wall surface of the middle-lower part of the groove-like coolant passage. Therefore, the metal base member has a shape that conforms to the shape of the back surface of the rubber member (that is situated opposite to the contact surface).

A material for forming the metal base member is not particularly limited. It is preferable to use stainless steel (SUS), an aluminum alloy, and the like due to good long-life coolant resistance (LLC resistance) and high strength. The thickness of the metal base member is not particularly limited, and is appropriately selected.

In the cylinder bore wall thermal insulator 20 illustrated in FIGS. 4A and 4B, the rubber member is secured on the metal base member in a state in which the bendable parts that are formed on the upper side and the lower side of the metal base member are bent so that the rubber member is held between the metal base member and the bendable parts. Note that the rubber member may be secured on the metal base member in an arbitrary way. For example, the rubber member may be fused with the metal base member by heating, or bonded to the metal base member using an adhesive, or may be secured on the metal base member by fitting a protrusion provided to the metal base member into the rubber member.

When the cylinder bore wall thermal insulator (1) or (2) is used to insulate part of the cylinder bore wall that covers two adjacent cylinder bores (two cylinder bores), the rubber member comes in contact with part of the middle-lower part of the cylinder bore wall that defines the groove-like coolant passage (i.e., the cylinder bore-side wall surface of the middle-lower part of the groove-like coolant passage) that covers the two adjacent cylinder bores (two cylinder bores). When the cylinder bore wall thermal insulator (1) or (2) is used to insulate part of the cylinder bore wall that covers three consecutive cylinder bores (three cylinder bores), the rubber member comes in contact with part of the middle-lower part of the cylinder bore wall that defines the groove-like coolant passage (i.e., the cylinder bore-side wall surface of the middle-lower part of the groove-like coolant passage) that covers the three consecutive cylinder bores (three cylinder bores). Note that part of the rubber member that insulates the cylinder bore wall that covers one cylinder bore is referred to as "bore-covering part". Specifically, when the cylinder bore wall thermal insulator (1) or (2) is used to insulate part of the cylinder bore wall that covers two cylinder bores, the rubber member includes two bore-covering parts. When the cylinder bore wall thermal insulator (1) or (2) is used to insulate part of the cylinder bore wall that covers three cylinder bores, the rubber member includes three bore-covering parts. The cylinder bore wall thermal insulator (1) or (2) is provided to (i.e., the rubber member comes in contact with) part of the cylinder bore-side wall surface of the middle-lower part of the groove-like coolant passage that covers the end bore that is situated on one end, part of the cylinder bore-side wall surface of the middle-lower part of the groove-like coolant passage that covers the end bore that is situated on the other end, or part of the cylinder bore-side wall surface of the middle-lower part of the groove-like coolant passage that covers the intermediate bore. The rubber member included in the cylinder bore wall thermal insulator (1) or (2) includes a part that comes in contact with two or three wall surfaces among the wall surface that covers the end bore that is situated on one end, the wall surface that covers the end bore that is situated on the other end, and the wall surface that covers one or more intermediate bores. The cylinder bore wall thermal insulator (3) is used to insulate part of the cylinder bore wall that covers one cylinder bore. Therefore, the rubber member comes in contact with part of the middle-lower part of the cylinder bore wall that defines the groove-like coolant passage (i.e., the cylinder bore-side wall surface of the middle-lower part of the groove-like coolant passage) that covers the one cylinder bore. The rubber member included in the cylinder bore wall thermal insulator (3) includes one bore-covering part. The cylinder bore wall thermal insulator (3) is provided to (i.e., the rubber member comes in contact with) part of the cylinder bore-side wall surface of the middle-lower part of the groove-like coolant passage that covers the end bore that is situated on one end, part of the cylinder bore-side wall surface of the middle-lower part of the groove-like coolant passage that covers the end bore that is situated on the other end, or part of the cylinder bore-side wall surface of the middle-lower part of the groove-like coolant passage that covers the intermediate bore. The rubber member included in the cylinder bore wall thermal insulator (3) includes a part that comes in contact with the wall surface that covers the end bore that is situated on one end, the wall surface that covers the end bore that is situated on the other end, or the wall surface that covers the intermediate bore.

Figure 16:
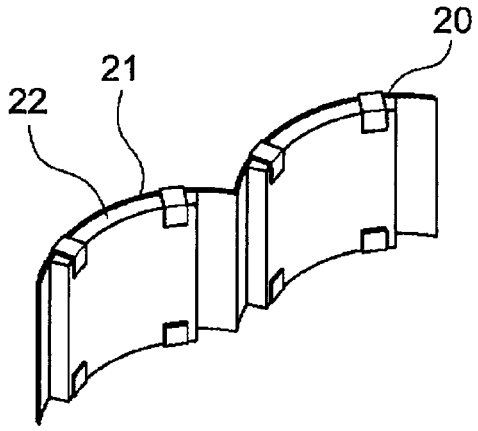
FIG. 16 is a schematic view illustrating another example of a cylinder bore wall thermal insulator according to one embodiment of the invention.

In the example illustrated in FIGS. 4A and 4B, the bore-covering parts 36*a* and 36*b* are provided continuously. Note that the configuration is not limited thereto. For example, the cylinder bore wall thermal insulator (1) or (2) may have a configuration as illustrated in FIG. 16 in which the rubber member is divided corresponding to each cylinder bore. The cylinder bore wall thermal insulator (1) or (2) may have a configuration in which the rubber member divided corresponding to each bore wall (see FIG. 16) is further divided into a plurality of segments. Specifically, the cylinder bore wall thermal insulator (1) or (2) may have a configuration in which the bore-covering parts are provided continuously, or provided discontinuously. It is preferable that the cylinder bore wall thermal insulators (1) and (2) have a configuration in which the bore-covering parts are provided continuously since the cylinder bore wall thermal insulators (1) and (2) are rarely displaced in the groove-like coolant passage due to vibrations or the flow of the coolant.

The rubber member (one bore-covering part) included in the cylinder bore wall thermal insulator (3) may be formed integrally, or may be divided into a plurality of segments.

In the cylinder bore wall thermal insulators (1), (2), and (3), the rubber member may cover the entirety of the cylinder bore-side wall surface of the middle-lower part of the groove-like coolant passage (that covers one, two, or three cylinder bores), or may cover only part of the cylinder bore-side wall surface of the middle-lower part of the groove-like coolant passage that requires thermal insulation.

The metal base member included in the cylinder bore wall thermal insulator (1) or (2) includes two or three bore-covering parts. The term "bore-covering part" used herein in connection with the metal base member refers to part of the metal base member on which the bore-covering part of the rubber member is secured. Specifically, when the cylinder bore wall thermal insulator (1) or (2) is used to insulate part of the cylinder bore wall that defines the groove-like coolant passage and covers two cylinder bores, the metal base member includes two bore-covering parts. When the cylinder bore wall thermal insulator (1) or (2) is used to insulate part of the cylinder bore wall that defines the groove-like coolant passage and covers three cylinder bores, the metal base member includes three bore-covering parts. The bore-covering part of the rubber member is secured on the bore-covering part of the metal base member. The metal base member is formed integrally from one end to the other end. Specifically, the bore-covering parts of the metal base member are provided continuously. In the example illustrated in FIGS. 4A and 4B, the metal base member is formed of a single metal sheet. Note that the configuration is not limited thereto. The metal base member may be formed of a single metal sheet, or may be formed by bonding a plurality of metal sheets, as long as the metal base member is formed integrally from one end to the other end.

Since the cylinder bore wall thermal insulator (3) is used to insulate part of the cylinder bore wall that defines the groove-like coolant passage and covers one cylinder bore, the metal base member includes one bore-covering part. The bore-covering part of the rubber member is secured on the bore-covering part of the metal base member. The metal base member is formed integrally from one end to the other end.

The elastic member is provided to the metal base member. The elastic member is elastically deformed when the cylinder bore wall thermal insulator according to one embodiment of the invention has been provided to the middle-lower part of the groove-like coolant passage, and biases the metal base member so as to press the rubber member against the cylinder bore-side wall surface of the middle-lower part of the groove-like coolant passage.

In the cylinder bore wall thermal insulators (1), (2), and (3), one or more elastic members are provided to each bore-covering part of the metal base member. Specifically, the elastic member is provided to each bore-covering part of the metal base member at at least one position in the arc direction when the cylinder bore wall thermal insulator (1), (2), or (3) is viewed from above. It is preferable that the elastic member be provided to each bore-covering part of the metal base member at two or more positions (particularly preferably three or more positions) in the arc direction when the cylinder bore wall thermal insulator (1), (2), or (3) is viewed from above. In the cylinder bore wall thermal insulator 20 illustrated in FIGS. 4A and 4B, the elastic member is provided to each bore-covering part of the metal base member at two positions in the arc direction.

The configuration of the elastic member is not particularly limited. The elastic member may be a plate-like elastic member, a coil-like elastic member, a leaf spring, a torsion spring, an elastic rubber, or the like. A material for forming the elastic member is not particularly limited. It is preferable to use stainless steel (SUS), an aluminum alloy, and the like due to good LLC resistance and high strength. It is preferable to use a metal elastic member (e.g., metal leaf spring, coil spring, leaf spring, or torsion spring) as the elastic member.

The configuration, the shape, the size, the position, the number, and the like of the elastic member(s) are appropriately selected taking account of the shape of the groove-like coolant passage and the like so that the rubber member is biased by the elastic member with an appropriate force when the cylinder bore wall thermal insulator (1), (2), or (3) has been provided to the middle-lower part of the groove-like coolant passage.

Figure 19:
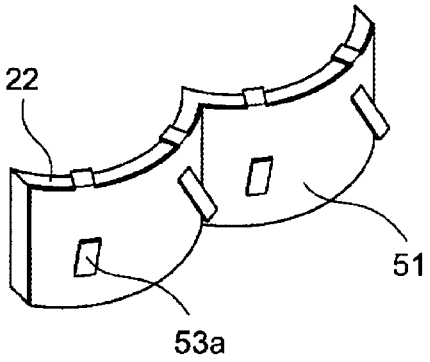
FIG. 19 is a schematic view illustrating another example of a method for providing an elastic member.
Figure 20:
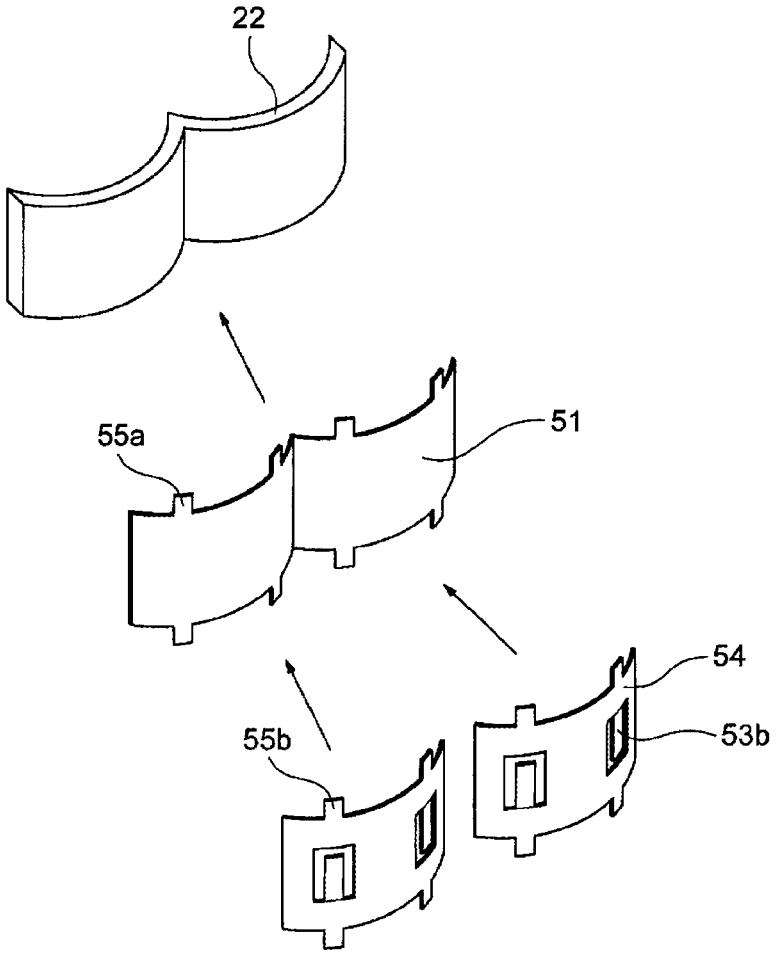
FIG. 20 is a schematic view illustrating another example of a method for providing an elastic member.

In the cylinder bore wall thermal insulator 20 illustrated in FIGS. 4A and 4B, the elastic member is integrally formed with the metal base member. Note that the elastic member may be provided to the metal base member in an arbitrary way. For example, a metal elastic member (e.g., metal leaf spring, metal coil spring, leaf spring, or torsion spring) may be welded to the metal base member. In the example illustrated in FIG. 19, a metal leaf spring 53*a* formed by a rectangular metal sheet is provided by welding to a metal base member 51 (that is not provided with the clipping target part). As illustrated in FIG. 20, the elastic member may be provided to the metal base member by providing the metal base member 51 (that is not provided with the clipping target part), and a metal leaf spring member 54 for providing a metal leaf spring in which the clipping target parts have been removed so that metal leaf springs 53*b* are formed, stacking the metal base member 51 and the metal leaf spring member 54 on the rubber member 22, and bending bendable parts 55*a* and 55*b* to secure the metal base member 51 on the rubber member 22, and secure the metal leaf springs 53*b* (i.e., elastic members) on the rubber member 22 through the metal base member 51.

Figure 17:
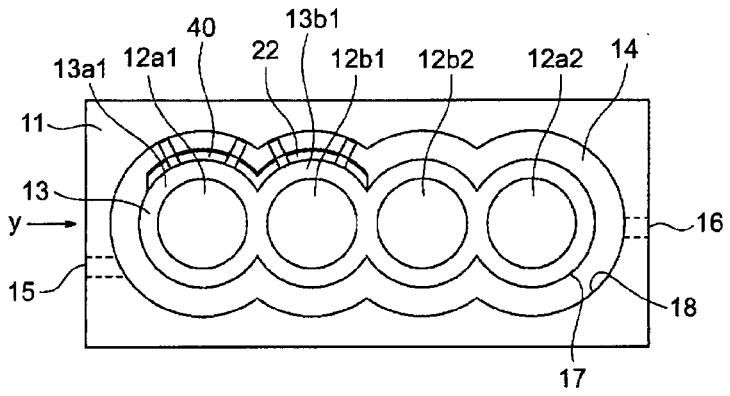
FIG. 17 is a schematic view illustrating a state in which a cylinder bore wall thermal insulator has been provided to the cylinder block (11) illustrated in FIG. 1.
Figure 18:
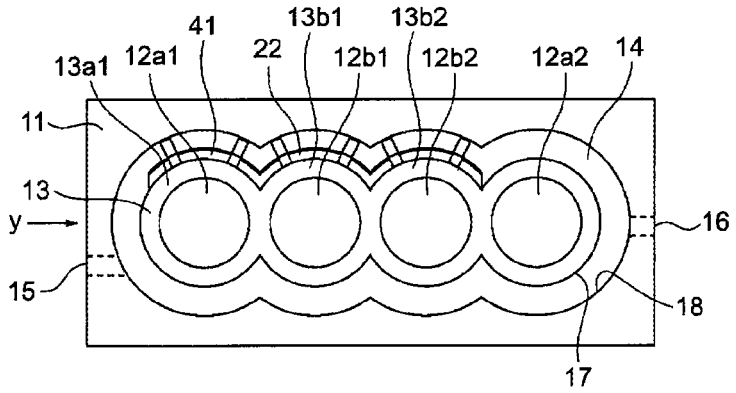
FIG. 18 is a schematic view illustrating a state in which a cylinder bore wall thermal insulator has been provided to the cylinder block (11) illustrated in FIG. 1.

The cylinder bore wall thermal insulators (1), (2), and (3) are provided to the middle-lower part of the groove-like coolant passage at an appropriately selected position (i.e., part of the cylinder bore wall that is insulated using the cylinder bore wall thermal insulators (1), (2), and (3) is appropriately selected). In the example illustrated in FIG. 9, the cylinder bore wall thermal insulator 20 is provided to the middle-lower part of the groove-like coolant passage 14 so as to insulate the bore wall 13*b*1 that defines the intermediate bore 12*b*1, and the bore wall 13*b*2 that defines the intermediate bore 12*b*2. Note that the cylinder bore wall thermal insulator 20 may be provided to the middle-lower part of the groove-like coolant passage 14 as illustrated in FIGS. 17 and 18. In the example illustrated in FIG. 17, a cylinder bore wall thermal insulator 40 is provided to the middle-lower part of the groove-like coolant passage 14 so as to insulate the bore wall 13*a*1 that defines the end bore 12*a*1, and the bore wall 13*b*1 that defines the intermediate bore 12*b*1. In the example illustrated in FIG. 18, a cylinder bore wall thermal insulator 41 is provided to the middle-lower part of the groove-like coolant passage 14 so as to insulate the bore wall 13*a*1 that defines the end bore 12*a*1, the bore wall 13*b*1 that defines the intermediate bore 12*b*1, and the bore wall 13*b*2 that defines the intermediate bore 12*b*2.

An internal combustion engine according to one embodiment of the invention includes the cylinder bore wall thermal insulator (1), (2), or (3) that is provided to a middle-lower part of a groove-like coolant passage. In the internal combustion engine according to one embodiment of the invention, the cylinder bore wall thermal insulator (1), (2), or (3) is provided to part of the middle-lower part of the groove-like coolant passage that requires thermal insulation. Specifically, the cylinder bore wall thermal insulator (1), (2), or (3) is selectively provided to part of the internal combustion engine according to one embodiment of the invention that requires thermal insulation.

An automobile according to one embodiment of the invention includes the internal combustion engine according to one embodiment of the invention.

When using a thermal insulator that has a configuration in which a thermal insulation part is formed to surround the entire cylinder bore-side wall surface of the middle-lower part of the groove-like coolant passage, it is impossible to selectively insulate only part of the middle-lower part of the groove-like coolant passage that requires thermal insulation.

On the other hand, the cylinder bore wall thermal insulators (1), (2), and (3) can selectively insulate only part of the middle-lower part of the groove-like coolant passage that requires thermal insulation. Since the cylinder bore wall thermal insulators (1), (2), and (3) have a configuration in which one or more elastic members are provided corresponding to each bore-covering part of the metal base member, the rubber member is uniformly pressed against the insulation target cylinder bore-side wall surface of the middle-lower part of the groove-like coolant passage. Since the cylinder bore wall thermal insulators (1) and (2) have a configuration in which the metal base member is integrally formed (i.e., the metal base member is not divided into a plurality of bore-covering parts), the cylinder bore wall thermal insulators (1) and (2) are rarely displaced in the groove-like coolant passage due to vibrations or the flow of the coolant.

INDUSTRIAL APPLICABILITY

According to the embodiments of the invention, since the difference in the amount of deformation between the upper part and the middle-lower part of the cylinder bore wall of an internal combustion engine can be reduced (i.e., friction with respect to a piston can be reduced), it is possible to provide a fuel-efficient internal combustion engine.

REFERENCE SIGNS LIST

8 Lowermost position
9 Uppermost position
10 Intermediate position
11 Cylinder block
12 Bore
12*a*1, 12*a*2 End bore
12*b*1, 12*b*2 Intermediate bore
13, 13*a*1, 13*a*2, 13*b*1, 13*b*2 Cylinder bore wall
14 Groove-like coolant passage
15 Coolant inlet
16 Coolant outlet
17 Wall surface of cylinder bore wall (13) that defines groove-like coolant passage (14)
18 Wall surface of groove-like coolant passage (14) opposite to cylinder bore wall (13)
20, 40, 41 Cylinder bore wall thermal insulator
21 Metal base member
22 Rubber member
23 Metal leaf spring member
24 Bendable part
25 Contact surface
26 One end
27 Other end
30 Metal sheet
31, 32 Clipping target part
33 Back surface
36 Bore-covering part
38 Bore-covering part
39*a* One end
39*b* Other end

The invention claimed is:

1. A cylinder bore wall thermal insulator that is provided to a middle-lower part of a groove-like coolant passage of a cylinder block included in an internal combustion engine that includes a plurality of cylinder bores, and insulates part of a cylinder bore wall covering two or more of the cylinder bores, the cylinder bore wall thermal insulator comprising:

a single rubber member that comes in contact with a cylinder bore-side wall surface of the middle-lower part of the groove-like coolant passage and that covers the two or more of the cylinder bores and boundaries of the two or more of the cylinder bores, a metal base member on which the single rubber member is secured, and two or more elastic members that are provided to the metal base member, and biases the metal base member so that the metal base member presses the rubber member against the cylinder bore-side wall surface of the middle-lower part of the groove-like coolant passage, the metal base member including a plurality of bore-covering parts and being integrally formed from one end to the other end thereof, and the two or more elastic members being provided to each of the plurality of bore-covering parts of the metal base member.

2. The cylinder bore wall thermal insulator according to claim 1, the cylinder bore wall thermal insulator being provided to the middle-lower part of the groove-like coolant passage of the cylinder block included in the internal combustion engine that includes four or more of the cylinder bores, and insulating part of the cylinder bore wall covering two or three of the cylinder bores, wherein the single rubber member that comes in contact with the cylinder bore-side wall surface of the middle-lower part of the groove-like coolant passage covers the two or three of the cylinder bores, the plurality of bore-covering parts includes two or three bore-covering parts.

3. The cylinder bore wall thermal insulator according to claim 2, wherein the metal base member and the two or more elastic members are integrally formed by forming a metal sheet.

4. An internal combustion engine comprising the cylinder bore wall thermal insulator according to claim 3.

5. An automobile comprising the internal combustion engine according to claim 4.

6. An internal combustion engine comprising the cylinder bore wall thermal insulator according to claim 2.

7. An automobile comprising the internal combustion engine according to claim 6.

8. The cylinder bore wall thermal insulator according to claim 1, wherein the plurality of cylinder bores includes three cylinder bores, and the cylinder bore-wall insulator insulates part of the cylinder bore wall covering two of the cylinder bores, wherein the single rubber member that comes in contact with the cylinder bore-side wall surface of the middle-lower part of the groove-like coolant passage that covers two of the cylinder bores, the plurality of bore-covering parts includes two bore-covering parts.

9. The cylinder bore wall thermal insulator according to claim 8, wherein the metal base member and the two or more elastic members are integrally formed by forming a metal sheet.

10. An internal combustion engine comprising the cylinder bore wall thermal insulator according to claim 9.

11. An automobile comprising the internal combustion engine according to claim 10.

12. An internal combustion engine comprising the cylinder bore wall thermal insulator according to claim 8.

13. An automobile comprising the internal combustion engine according to claim 12.

14. The cylinder bore wall thermal insulator according to claim 1, wherein the metal base member and the two or more elastic members are integrally formed by forming a metal sheet.

15. An internal combustion engine comprising the cylinder bore wall thermal insulator according to claim 14.

16. An automobile comprising the internal combustion engine according to claim 15.

17. An internal combustion engine comprising the cylinder bore wall thermal insulator according to claim 1.

18. An automobile comprising the internal combustion engine according to claim 17.

* * * * *